United States Patent [19]

Ricketts

[11] 4,326,751

[45] Apr. 27, 1982

[54] BLASTING TO A HORIZONTAL FREE FACE WITH MIXING OF FRAGMENTS

[75] Inventor: Thomas E. Ricketts, Grand Junction, Colo.

[73] Assignee: Occidental Oil Shale Inc., Grand Junction, Colo.

[21] Appl. No.: 200,136

[22] Filed: Oct. 24, 1980

Related U.S. Application Data

[63] Continuation of Ser. No. 76,287, Sep. 17, 1979, abandoned.

[51] Int. Cl.[3] ..... E21C 41/10

[52] U.S. Cl. ..... 299/2; 102/312; 299/13

[58] Field of Search ..... 299/2, 13; 166/259, 166/299; 102/23

[56] References Cited

U.S. PATENT DOCUMENTS

| | | | |
|---|---|---|---|
| 4,043,595 | 8/1977 | French | 299/2 |
| 4,109,964 | 8/1978 | Ridley | 299/2 |
| 4,146,272 | 3/1979 | French | 299/2 |
| 4,192,554 | 3/1980 | Ricketts | 299/2 |
| 4,238,136 | 12/1980 | Ricketts | 299/2 |

OTHER PUBLICATIONS

Redpath "Application of Cratering Characteristics to Conventional Blast Design".

*Primary Examiner*—Ernest R. Purser

*Attorney, Agent, or Firm*—Christie, Parker & Hale

[57] ABSTRACT

An in situ oil shale retort is formed in a subterranean formation wherein the oil shale retort contains a fragmented permeable mass of formation particles containing oil shale. A limited void is formed in the subterranean formation and zones of unfragmented formation are left above and below the void and are loaded with explosive for explosively expanding unfragmented formation toward the void. The explosive is placed into the zones of unfragmented formation for forming a substantially horizontal array of main explosive charges and at least one substantially horizontal array of satellite explosive charges. Each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges. Explosive is detonated in the blastholes in a single round of explosions for explosively expanding at least one of the zones of unfragmented formation toward the void to form a fragmented permeable mass of formation particles containing oil shale in the oil shale retort.

123 Claims, 6 Drawing Figures

BLASTING TO A HORIZONTAL FREE FACE WITH MIXING OF FRAGMENTS

CROSS REFERENCE TO RELATED APPLICATIONS

This is a continuation of application Ser. No. 076,287, filed Sept. 17, 1979, now abandoned.

BACKGROUND OF THE INVENTION

The presence of large deposits of oil shale in the Rocky Mountain region of the United States has given rise to extensive efforts to develop methods for recovering shale oil from kerogen in the oil shale deposits. It should be noted that the term "oil shale" as used in the industry is in fact a misnomer; it is neither shale nor does it contain oil. It is a sedimentary formation comprising marlstone deposit with layers containing an organic polymer called "kerogen" which, upon heating, decomposes to produce liquid and gaseous products. It is the formation containing kerogen that is called "oil shale" herein, and the liquid hydrocarbon product is called "shale oil".

A number of methods have been proposed for processing oil shale which involve either first mining the kerogen-bearing shale and processing the shale on the ground surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; and 4,043,598 which are incorporated herein by this reference. These patents describe in situ recovery of liquid and gaseous hydrocarbon materials from a subterranean formation containing oil shale, wherein such formation is explosively expanded to form a stationary, fragmented permeable body or mass of formation particles containing oil shale within the formation, referred to herein as an in situ oil shale retort. Retorting gases are passed through the fragmented mass to convert kerogen contained in the oil shale to liquid and gaseous products, thereby producing retorted oil shale. One method of supplying hot retorting gases used for converting kerogen contained in the oil shale, as described in U.S. Pat. No. 3,661,423, includes establishing a combustion zone in the retort and introducing an oxygen supplying retort inlet mixture into the retort to advance the combustion zone through the fragmented mass. In the combustion zone, oxygen from the retort inlet mixture is depleted by reaction with hot carbonaceous materials to produce heat, combustion gas, and combusted oil shale. By the continued introduction of the retort inlet mixture into the fragmented mass, the combustion zone is advanced through the fragmented mass in the retort.

The combustion gas and the portion of the retort inlet mixture that does not take part in the combustion process pass through the fragmented mass on the advancing side of the combustion zone to heat the oil shale in a retorting zone to a temperature sufficient to produce kerogen decomposition, called "retorting". Such decomposition in the oil shale produces gaseous and liquid products, including gaseous and liquid hydrocarbon products, and a residual solid carbonaceous material.

The liquid products and the gaseous products are cooled by the cooler oil shale fragments in the retort on the advancing side of the retorting zone. The liquid hydrocarbon products, together with water produced in or added to the retort, collect at the bottom of the retort and are withdrawn. An off gas is also withdrawn from the bottom of the retort. Such off gas can include carbon dioxide generated in the combustion zone, gaseous products produced in the retorting zone, carbon dioxide from carbonate composition, and any gaseous retort inlet mixture that does not take part in the combustion process. The products of retorting are referred to herein as liquid and gaseous products.

U.S. Pat. No. 4,043,598 discloses a method for explosively expanding formation containing oil shale toward horizontal free faces to form a fragmented mass in an in situ oil shale retort. According to a method disclosed in that patent, a plurality of vertically spaced apart voids of similar horizontal cross-section are initially excavated one above another within the retort site. A plurality of vertically spaced apart zones of unfragmented formation are temporarily left between the voids. Explosive is placed in each of the unfragmented zones and detonated, preferably in a single round, to explosively expand each unfragmented zone into the voids to form a fragmented mass. Retorting of the fragmented mass is then carried out to recover shale oil from the oil shale.

U.S. patent application Ser. No. 929,250 titled "METHOD FOR EXPLOSIVE EXPANSION TOWARD HORIZONTAL FREE FACES FOR FORMING AN IN SITU OIL SHALE RETORT" filed July 31, 1978 by the applicant and assigned to the assignee of the present invention, now U.S. Pat. No. 4,192,554, describes a method for forming an in situ oil shale retort by expanding formation toward vertically spaced apart voids. Patent application Ser. No. 929,250 is incorporated herein by this reference.

It is desirable to form an in situ retort with a reasonably uniformly distributed void fraction, or a fragmented mass of reasonably uniform permeability so that oxygen supplying gas can flow reasonably uniformly through the fragmented mass during retorting operations. Techniques used for explosively expanding zones of unfragmented formation toward the horizontal free faces of formation adjacent the voids can control the uniformity of particle size or permeability of the fragmented mass. A fragmented mass having generally uniform permeability in horizontal planes across the fragmented mass avoids bypassing portions of the fragmented mass by retorting gas as can occur if there is gas channeling through the mass owing to non-uniform permeability.

When blasting toward a horizontal void, the spacing and location of explosive charges in the unfragmented formation to be explosively expanded can be important. It is especially important when blasting toward a limited void for forming an in situ retort having a fragmented permeable mass of oil shale particles with a substantially uniformly distributed void fraction.

A limited void is a void having a volume less than the volume required for free expansion of all the oil shale explosively expanded toward such a void. When oil shale is explosively expanded towards an unlimited void, a certain maximum void fraction is present in the fragmented mass resulting from such free expansion. When oil shale is expanded towards a limited void, the void fraction can be no more than permitted by the available void space of the limited void and may be less due to interactions with unfragmented oil shale, for example. It is believed that with oil shale confined by surrounding walls and capable of expanding only to such a limited void, gases from detonation do not have full opportunity to act upon expanding oil shale before the oil shale particles reach obstructions, such as adjacent walls, a face opposite to the expanding formation, or oil shale expanding from the opposite sides of the void. It is believed that because the oil shale particles are obstructed, the average void fraction of the fragmented permeable mass of oil shale particles explosively expanded toward a limited void is less than the maximum possible void fraction as defined hereinabove.

SUMMARY OF THE INVENTION

This invention relates to a method for forming an in situ oil shale retort in a retort site in a subterranean formation containing oil shale. The in situ oil shale retort contains a fragmented permeable mass of formation particles containing oil shale.

A portion of the formation is excavated to form at least one limited void in the subterranean formation, leaving zones of unfragmented formation above and below such a void, such a zone of unfragmented formation having a substantially horizontal free face adjoining the void. Substantially vertical blastholes are formed in at least one of the zones of unfragmented formation for forming at least one array of spaced apart blastholes. Explosive is placed into such blastholes for forming a substantially horizontal array of main explosive charges and at least one substantially horizontal array of satellite explosive charges. Each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges. Explosive is detonated in the blastholes in a single round of explosions for explosively expanding at least one of the zones of unfragmented formation toward the void to form a fragmented permeable mass of formation particles containing oil shale in an in situ oil shale retort.

DRAWINGS

These and other aspects of the invention will be more fully understood by referring to the following detailed description and accompanying drawings in which.

DETAILED DESCRIPTION

Figure 1:
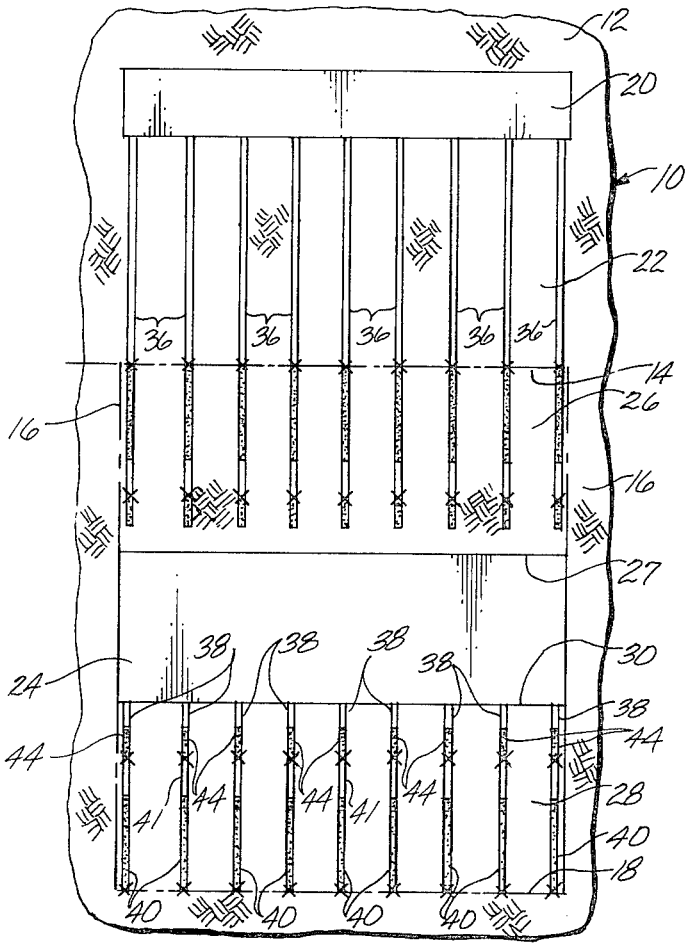
FIG. 1 is a fragmentary, semi-schematic vertical cross-sectional view showing a portion of subterranean formation containing oil shale prepared for explosive expansion for forming an in situ oil shale retort.

FIG. 1 is a semi-schematic, vertical cross-section at one stage during preparation of an in situ retort 10 which is being formed in a subterranean formation 12 containing oil shale. The in situ retort is rectangular in horizontal cross-section, having a top boundary 14, four vertically extending side boundaries 16, and a bottom boundary 18.

In the horizontal free face system of an exemplary embodiment, a base of operation 20 is excavated in the formation for providing effective access across substantially the entire horizontal cross-section of the retort being formed. The base of operation is used during formation of the retort, facilitates ignition over a top portion of fragmented permeable mass of formation particles, permits control of introduction of oxygen-containing gas into the retort, provides a location for testing properties of the fragmented mass, such as distribution of void fraction, and provides a location for evaluating performance of the retort during operation.

A substantially rectangular limited void 24 is excavated at a level spaced vertically below the base of operation leaving a layer of unfragmented formation which extends vertically between the base of operation 20 and the void 24. The void 24 excavated can comprise between about 15 to about 35% of the total volume of the retort being formed. A layer of unfragmented formation may be left above the void 24 to comprise a sill pillar 22 of unfragmented formation which extends from about the floor of the base of operation to the top boundary 14 of the retort being formed. The sill pillar acts as a barrier between the in situ oil shale retort and the base of operation during retorting operations, thereby protecting the base of operation from heat and gases evolved during such retorting operations.

The layer of unfragmented formation also comprises an upper zone 26 of unfragmented formation. The upper zone of unfragmented formation extends horizontally across the retort site between the top boundary 14 of the retort being formed and a substantially horizontal free face 27 above the void 24. A lower zone 28 of unfragmented formation is left in the subterranean formation below the void, wherein the lower zone 28 extends horizontally across the retort site between the bottom boundary 18 of the retort being formed and a substantially horizontal free face 30 at the floor of the void. If it is desired to form a relatively taller retort, additional voids can be excavated in the subterranean formation, as described in U.S. Pat. Nos. 4,043,597 and 4,043,598.

In the exemplary embodiment, a plurality of substantially vertical blastholes 36 are drilled through the sill pillar 22 and into the upper zone 26 of unfragmented formation from the base of operation 20 forming an array of spaced apart blastholes. A plurality of substantially vertical blastholes 38 are drilled into the lower zone 28 of unfragmented formation from the void 30 forming another array of spaced apart blastholes. The blastholes are shown out of proportion in the figures for clarity of illustration, i.e., the blastholes are actually much smaller in diameter relative to the formation than shown. The blastholes can be formed in a rectangular array including a square array or can be formed in other configurations if desired. The blastholes of the exemplary embodiment are generally perpendicular to the free faces of the unfragmented formation and are formed as a square array of blastholes with each blasthole being spaced apart an equal distance in each direction. When the retort being formed is not square in horizontal cross-section, but has sides of unequal length, it may be desirable to form a rectangular array of spaced apart blastholes which is not a square array.

Explosive is placed into the blastholes for forming a substantially horizontal array of main explosive charges and at least one substantially horizontal array of satellite explosive charges in both the upper and lower zones of unfragmented formation.

The main and satellite explosive charges in the upper zone of unfragmented formation can be formed having either a different or a substantially identical configuration as main and satellite explosive charges formed in the lower zone of unfragmented formation. When additional voids are excavated into the formation, the main and satellite explosive charges are preferably formed having a substantially identical configuration in each zone of unfragmented formation to be explosively expanded. An understanding, however, of the principles of this invention can be achieved by a description of the preparation of the lower zone of unfragmented formation for explosive expansion.

The lower zone 28 of unfragmented formation is prepared for explosive expansion by placing explosive into each of the blastholes 38 for providing a substantially horizontal array of main explosive charges 40. The main explosive charges extend from about the lower boundary 18 of unfragmented formation about half the distance to the free face 30 toward which such unfragmented formation is to be explosively expanded. Stemming 41, which can be sand or other inert material, is placed into each blasthole 38 above each of the main explosive charges 40. Explosive is thereafter placed into each of the blastholes 38 for forming a substantially horizontal array of satellite explosive charges 44. The satellite charges are located in a portion of unfragmented formation in the lower zone of unfragmented formation between the upper end of the main explosive charges 40 and the free face 30 towards which unfragmented formation is explosively expanded. Detonators designated by an "x" are placed into each of the main and satellite explosive charges at a location in each charge remote from the free face 30.

It is believed that the most effective configuration of explosive charges is a configuration wherein each main explosive charge is equal in length to about one-half the thickness of a zone of unfragmented formation to be explosively expanded. For example, when the height of the lower zone of unfragmented formation is about 50 feet, the preferred charge length of each main explosive charge is about 25 feet. Each of the main explosive charges is located in that portion of the zone of unfragmented formation most remote from the free face 30 toward which the unfragmented formation is to be explosively expanded.

Each of the satellite explosive charges 44 has a scaled point charge depth of burial substantially equal to the scaled point charge depth of burial of each of the main explosive charges 40.

By "substantially equal" it is meant that each satellite explosive charge has a scaled point charge depth of burial that is within at least about ±20% of the scaled point charge depth of burial of each main explosive charge. It is preferable that each satellite explosive charge have a scaled point charge depth of burial that is within about ±10% and, more preferably, within about ±5% of the scaled point charge depth of burial of each main explosive charge.

In addition, the actual depth of burial of each of the satellite explosive charges is less than about the actual depth of burial of each of the main explosive charges.

The actual depth of burial of each explosive charge is the distance between the free face toward which the unfragmented formation is to be explosively expanded and the center of mass of such an explosive charge. For example, the actual depth of burial of each of the main explosive charges 40 in the lower zone of unfragmented formation 26 is the distance from the substantially horizontal free face 30 to the center of mass of the explosive charge 40. The actual depth of burial of each of the main explosive charges 40 is, therefore, about 37.5 feet in the example mentioned above.

The scaled depth of burial as it applies to cratering and blasting to a horizontal free face is described in a paper by Bruce B. Redpath entitled "Application of Cratering Characteristics to a Conventional Blast Design".

The scaled point charge depth of burial (SDOB) of an explosive charge can be expressed in units of distance over weight to the $\frac{1}{3}$ power or preferably distance over energy of explosive to the $\frac{1}{3}$ power, e.g., $SDOB = L/W^{\frac{1}{3}}$ with units of $mm/cal^{\frac{1}{3}}$. The distance, L, referred to as burden distance in the equation for scaled depth of burial, is the actual depth of burial as described hereinabove. The weight or energy, W, of the explosive is the total weight or energy of the column of explosive. In one example of SDOB for forming an in situ oil shale retort, each blasthole contained an explosive charge having an SDOB of about 11 $mm/cal^{\frac{1}{3}}$.

The scaled point charge depth of burial can be altered by changing the actual depth of burial of an explosive charge or by changing the amount of explosive in the blasthole, such as by changing the diameter of the blasthole and/or by using a more or less energetic explosive in such a blasthole.

The charge length of a satellite explosive charge is determined by the energy of explosive to be used and the diameter of the blastholes for forming such an explosive charge. A combination of charge length and explosive type is chosen to provide each satellite explosive charge with a scaled point charge depth of burial substantially equal to the scaled point charge depth of burial of each main explosive charge.

Having a satellite explosive charge in the layer of unfragmented formation between the main explosive charges 40 and the free face 30 enhances the mixing and rotation of oil shale particles in such a layer during explosive expansion. In addition, both uniformity of size of oil shale particles formed and mixing and rotation of oil shale particles in the entire zone of unfragmented formation are enhanced when the scaled point charge depth of burial of each satellite explosive charge is equal to the scaled point charge depth of burial of each of the main explosive charges. Enhancing the uniformity of size and the mixing and rotation of oil shale particles is especially important when explosively expanding formation toward the limited void 24, for forming a fragmented permeable mass of formation particles having a generally uniform permeability and a reasonably uniformly distributed void fraction as described herinabove.

Explosive is loaded into the blastholes 36 in the upper zone of unfragmented formation for providing main and salellite explosive charges which are substantially indentical to the main and satellite explosive charges in the lower zone of unfragmented formation.

Although explosive charges are placed into each blasthole in one aspect of the exemplary embodiment, forming both a main and a satellite explosive charge in each blasthole, it can be desirable to form satellite explosive charges in only a portion of such blastholes. For example, the desired amount of mixing and rotation of particles may be able to be achieved by placing satellite explosive charges in a portion of the blastholes used for forming the array of main explosive charges.

The main and satellite explosive charges are detonated in the blastholes 36 in the upper zone of unfragmented formation and in the blastholes 38 in the lower zone of unfragmented formation in a single round for explosively expanding the upper zone of unfragmented formation and the lower zone of unfragmented formation toward the void 24 to form a fragmented permeable mass of formation particles containing oil shale in the in situ oil shale retort.

When either one void is excavated or a plurality of voids are excavated within a subterranean formation, the explosive expansion of unfragmented formation can be downwardly toward an underlying void, upwardly toward an overlying void, or can involve zones of formation both above and below a void expanded simultaneously toward such a void as described in the present embodiment. In addition, when more than one void is excavated in the formation, a zone of unfragmented formation can be expanded partly upwardly toward an overlying void and partly downwardly toward an underlying void.

When the main and satellite explosive charges occupy the same blasthole, the main and satellite explosive charges in each blasthole are detonated substantially simultaneously. The satellite explosive charges are not detonated prior to detonation of the main explosive charges because there is not sufficient interaction between such satellite explosive charges for optimum effectiveness for the exemplary embodiment described hereinabove. When providing the array of main explosive charges, a ratio of actual depth of burial to spacing distance is used for providing optimum interaction between such main explosive charges. On the other hand, the satellite explosive charges have an actual depth of burial less than the actual depth of burial of each of the main explosive charges. The ratio of actual depth of burial to spacing distance is less for the satellite explosive charges than for the main explosive charges, thereby providing less interaction between satellite explosive charges than between main explosive charges. Because the satellite explosive charges have less interaction, it can be undesirable to detonate such satellite explosive charges prior to the detonation of the main explosive charges. Thus, it is desirable to detonate main and satellite explosive charges in the same blasthole substantially simultaneously to obtain the advantage of the combined effects of the main and satellite explosive charges.

In practicing principles of this invention, other configurations of main and satellite explosive charges can also be used for explosive expansion of unfragmented formation.

Figure 2:
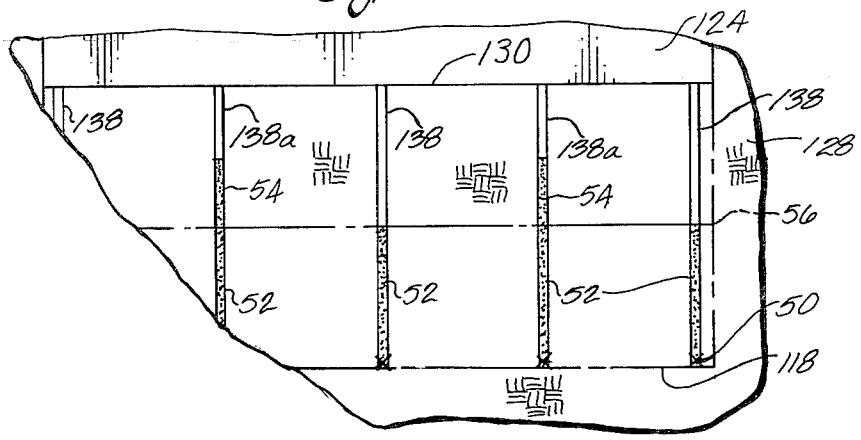
FIG. 2 is a fragmentary, semi-schematic vertical cross-sectional view showing a portion of the subterranean formation of FIG. 1 prepared for explosive expansion having an arrangement of explosive charges.

FIG. 2 is a semi-schematic vertical cross-sectional view of a lower zone of unfragmented formation 128 having blastholes 138 drilled from a horizontal free face 130 to the bottom boundary 118 of a retort being formed. The lower zone 128 of unfragmented formation is to be explosively expanded upwardly toward the void 124. Detonators designated by an "x" are placed in the bottom of each of the blastholes and a first explosive charge is placed in each blasthole for forming a substantially horizontal array of main explosive charges 52. In this exemplary embodiment, explosive is placed above such main explosive charges in some, but not all, of the blastholes for forming satellite explosive charges 54. Each of the main explosive charges is formed having a substantially equal charge length. Each main explosive charge is located in that portion of the unfragmented formation most remote from the free face toward which the unfragmented formation is to be explosively expanded. The main explosive charges extend from the bottom boundary 118 of the unfragmented formation about half the thickness of the unfragmented formation to be explosively expanded. To illustrate, a substantially horizontal plane 56 passes through the upper end of each main explosive charge. For example, in an embodiment where the lower zone of unfragmented formation 128 is about 50 feet thick, each main explosive charge has a charge length of about 25 feet.

The satellite explosive charges 54 are above the main explosive charges in a plurality of the blastholes, such blastholes being designated 138*a*. The column of explosive in these blastholes is continuous, that is, the length of the column is more than half the thickness of the zone of unfragmented formation to be explosively expanded. The actual depth of burial of each of the satellite explosive charges 54 is less than the actual depth of burial of each of the main explosive charges. For example, each of the satellite explosive charges 54 extends about half the distance from the plane 56 to the free face 30. The depth of burial of each of the satellite explosive charges is about $18\frac{3}{4}$ feet in the example mentioned above. It is preferred that the scaled point charge depth of burial of each of the satellite explosive charges be substantially equal to the scaled point charge depth of burial of the main explosive charges. To form main and satellite explosive charges which have a substantially equal scaled point charge depth of burial in the exemplary embodiment, a first explosive charge having a first energy per unit volume of explosive charge can be used for forming each main explosive charge. A second explosive charge having a second energy per unit volume of explosive charge can be used for forming each satellite explosive charge where such second energy per unit volume is less than the first energy per unit volume. The main and satellite explosive charges, therefore, are comprised of different explosives, the explosives having different energy per unit volumes in order to obtain substantially equal scaled depth of burial for the main and satellite explosive charges in each blasthole.

Alternatively, if desired, main and satellite explosive charges can be formed having substantially equal scaled point charge depth of burial by using blastholes where each blasthole is formed having more than one blasthole diameter. For example, the lower portion of a blasthole can be formed having a larger diameter than an upper portion. Blastholes can be provided with blasthole diameters which enable formation of main and satellite explosive charges which have substantially equal scaled point charge depth of burial when using the same explosive for both charges.

When the same explosive is used for forming both the main and satellite explosive charges in an exemplary embodiment as shown in FIG. 2, each of the satellite explosive charges has a scaled point charge depth of burial which is less than each of the main explosive charges. The use of the same explosive for forming the main and satellite explosive charges, however, can be for convenience or other like reasons.

When the scaled point charge depth of burial of each satellite explosive charge is not equal to the scaled point charge depth of burial of each of the main explosive charges, optimum interaction between satellite and main explosive charges is not obtained. For example, when each of the satellite explosive charges has a scaled point charge depth of burial which is less than the scaled point charge depth of burial of each of the main explosive charges, each satellite charge provides more mixing and rotation of formation particles than each main explosive charge which can cause over-expansion. In addition, the particles formed by such satellite explosive charges will not have the same average size distribution as the particles formed by the main explosive charges, thereby enhancing a non-uniform void fraction distribution.

Figure 3:
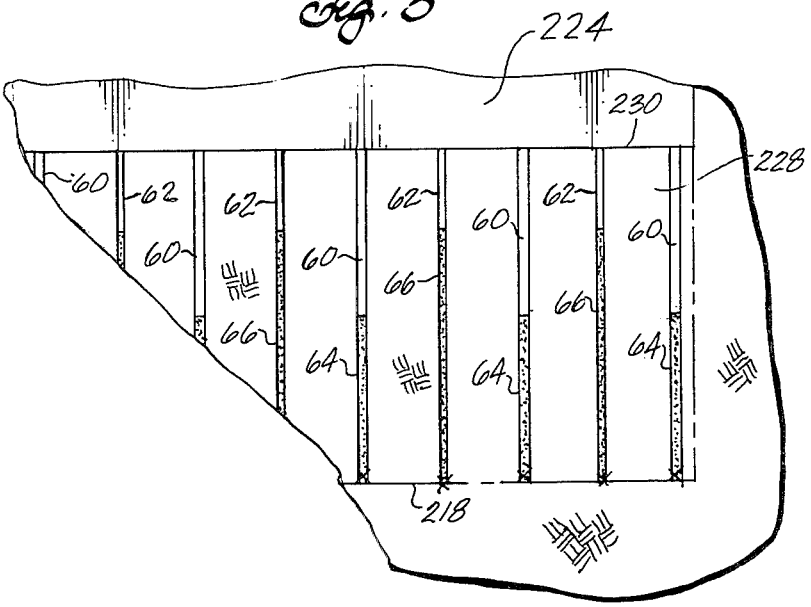
FIG. 3 is a fragmentary, semi-schematic vertical cross-sectional view showing a portion of the subterranean formation prepared for explosive expansion having another arrangement of explosive charges.

In another embodiment, referring to FIG. 3, a lower zone 228 of unfragmented formation can be prepared for explosive expansion toward a void 224 by forming a first set of blastholes 60. Each of the blastholes of the first set of blastholes 60 has a substantially equal hole diameter. A second set of blastholes 62 is also formed in the lower zone of unfragmented formation 228 wherein each blasthole of the second set of blastholes 62 has a substantially equal hole diameter. The hole diameter of each of the second blastholes 62 is less than the hole diameter of each of the first blastholes. Explosive is placed into the first set of blastholes for providing a substantially horizontal array of main explosive charges 64 and explosive is placed into the second set of blastholes for providing a substantially horizontal array of satellite explosive charges 66. Each of the satellite explosive charges 66 has a scaled point charge depth of burial substantially equal to the scaled point charge depth of burial of each of the main explosive charges 64. The actual depth of burial of each of the satellite explosive charges is less than the actual depth of burial of each of the main explosive charges. For example, when the zone of unfragmented formation 228 is about 60 feet thick, each of the main explosive charges occupies the bottom half of each of the blastholes of the first set of blastholes 60. Preferably, the charge length of each of the main explosive charges 64 is about 30 feet and the actual depth of burial of each of the main explosive charges is therefore about 45 feet. The actual depth of burial is from about the center of mass of each such explosive charge to the substantially horizontal free face 230, as described hereinabove. Each of the satellite explosive charges 66 has an actual depth of burial less than the actual depth of burial of each main explosive charge because, although both the main and satellite explosive charges start at the bottom boundary 218, each satellite explosive charge has a longer charge length than each main explosive charge. For example, in the embodiment shown, the charge length of each of the satellite explosive charges is about 45 feet and the actual depth of burial is therefore about 37.5 feet. The combination of blasthole diameter, type of explosive, and charge length is selected to form each satellite explosive charge having the same scaled point charge depth of burial as each main explosive charge.

Figure 4:
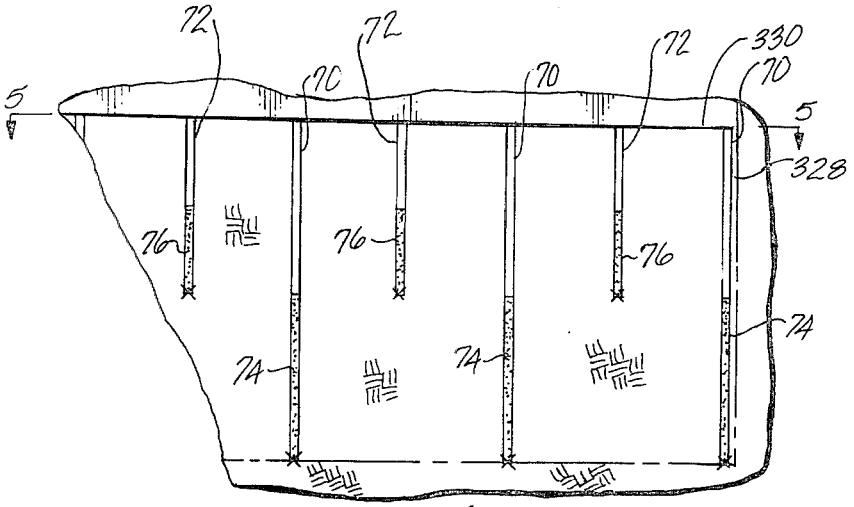
FIG. 4 is a fragmentary, semi-schematic vertical cross-sectional view showing a portion of the subterranean formation prepared for explosive expansion having another arrangement of explosive charges.

In another embodiment, as shown in FIG. 4, a first substantially rectangular array of spaced apart blastholes 70 is formed in a lower zone of unfragmented formation 328. A second substantially rectangular array of spaced apart blastholes 72 is also formed in such a lower zone of unfragmented formation 328. The second array of blastholes has substantially the same spacing distance as the first array and such a second array is diagonally offset from the first array by less than about the spacing distance.

Figure 5:
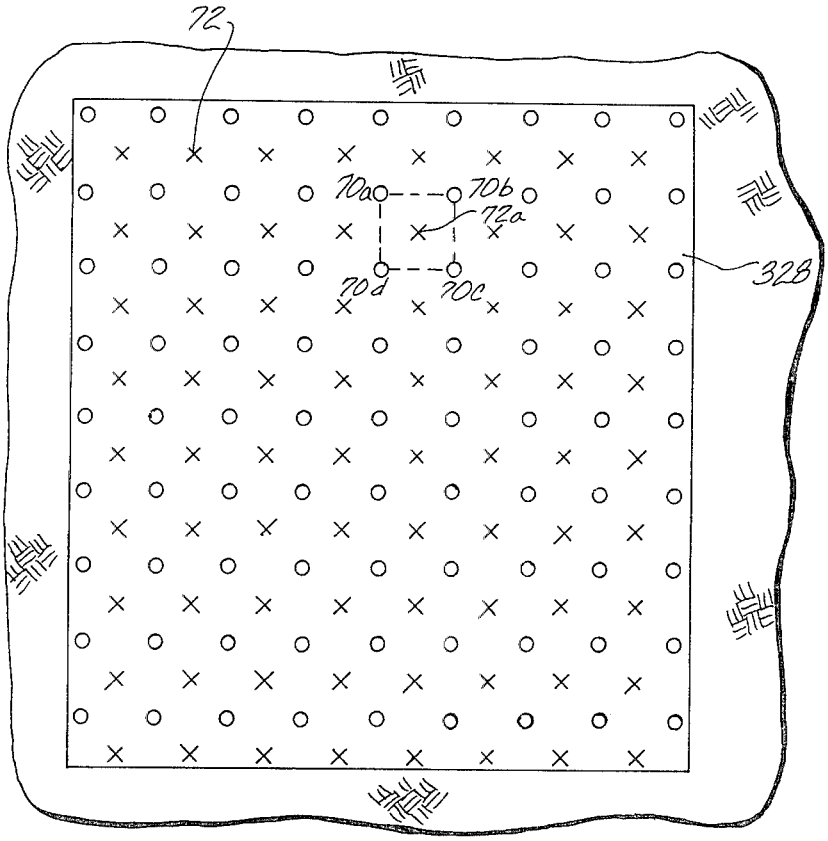
FIG. 5 is a fragmentary, semi-schematic horizontal cross-sectional view taken on line 5—5 of FIG. 4.

Spacing distance is defined as the distance between adjacent blastholes and can be further understood by referring to FIG. 5. FIG. 5 is a top view of the zone of unfragmented formation 328 taken on line 5—5 of FIG. 4. In this example, which is used to clarify the meaning of spacing distance, the first array of spaced apart blastholes 70 is shown as circles in a rectangular array, which is a square array for purposes of exposition herein, i.e., the blastholes 70*a*, 70*b*, 70*c*, and 70*d* define a square. The spacing distance is the length of the side of such a square. If, for example, the zone of unfragmented formation to be explosively expanded were not symmetrical, i.e., the length does not equal the width, an array of blastholes can be used which is not a square array. When a rectangular array which is not a square array is used, each rectangle defined by each four adjacent blastholes has sides which are not equal. The spacing distance in a rectangular array is the square root of the length times the width of such a rectangle defined by each four adjacent blastholes. The length of a side of each rectangle defined by four adjacent blastholes in an array should be no less than about 75% of the length of another side of such a rectangle so that there is proper interaction between blastholes in such an array.

The second array of blastholes 72 is designated by "x"s in FIG. 5. It is preferred that each of the blastholes 72 be about equidistant from each of the four blastholes 70 defining each square. For example, it is preferred that blasthole 72*a* be about equidistant from blastholes 70*a*, 70*b*, 70*c*, and 70*d*.

Referring again to FIG. 4, explosive is placed into each blasthole of the first substantially rectangular array of spaced apart blastholes 70 for forming the array of main explosive charges 74. Explosive is placed into each blasthole of the second substantially rectangular array of spaced apart blastholes 72 for forming the array of satellite explosive charges 76. The array of satellite explosive charges formed is substantially between each of such main explosive charges and a free face 330 toward which the unfragmented formation 328 is to be explosively expanded.

In an example, for purposes of exposition, the unfragmented formation 328 to be expanded is about 60 feet thick. It is preferred that explosive is placed into each blasthole 70 for forming each main explosive charge having charge length of about 30 feet or about one-half the thickness of the unfragmented formation to be explosively expanded. Each of the blastholes of the second array of blastholes 72 can be about 30 feet in length. It is preferred that explosive is placed into the bottom half of each such blasthole 72 for forming each satellite explosive charge 76. It is preferred that each such satellite explosive charge has a charge length equal to about one-half the thickness of the unfragmented formation between the bottom of such a blasthole and the free face toward which the unfragmented formation is to be explosively expanded. The combination of the diameter of blastholes of the second array of blastholes 72, charge length of each satellite explosive charge 76, and type of explosive is chosen such that the scaled point charge depth of burial of each such satellite explosive charge 76 is substantially equal to the scaled point charge depth of burial of each of the main explosive charges 74. The satellite explosive charges of the present embodiment can be made either shorter or longer than the explosive charge 76 depending on the desired additional mixing and rotation of particles from the zone of unfragmented formation between the main explosive charge and the free face 330. Additionally, the blastholes 72 can be made longer than 30 feet, thereby providing satellite explosive charges that are partly in the same layer of unfragmented formation as the main explosive charges and partly in the layer of unfragmented formation between the main explosive charge and the free face 330.

Also, if desired, in an exemplary embodiment such as the embodiment as shown in FIG. 4, a satellite explosive charge can be formed in each of the blastholes 70. Each of the blastholes 70, therefore, will have both a main explosive charge 74 and a satellite explosive charge 76.

By forming additional satellite explosive charges in each of the blastholes 70, there is provided additional explosive in the lower zone of unfragmented formation 328 to enhance interaction between such satellite explosive charges.

In addition to preparing the lower zone of unfragmented formation for explosive expansion, the upper zone of unfragmented formation can also be prepared for explosive expansion using principles as described in any of the alternative embodiments for preparation of such a lower zone.

When blastholes in an in situ oil shale retort site have been formed and are loaded with explosive as described hereinabove, explosive is detonated in a single round in the blastholes in at least one of the zones of unfragmented formation. Detonation in a single round, as used herein, means detonation of a number of explosive charges either simultaneously or with only a short time delay between separate detonations. A time delay between explosions in a sequence is short when formation explosively expanded by detonation of one explosive charge has either not yet moved or is still in motion at the time of detonation of a subsequent explosive charge. The detonation of explosive in the blastholes provides for explosively expanding such a zone of unfragmented formation toward a void such as the limited void 24 to form a fragmented permeable mass of formation particles containing oil shale in the in situ oil shale retort 10 being formed.

The satellite and main explosive charges can be detonated in a single round, either simultaneously or in groups. For example, the main and satellite explosive charges can be formed for providing at least one group of satellite explosive charges and at least one group of main explosive charges, wherein a first group of main explosive charges is detonated substantially simultaneously with a first group of satellite explosive charges. The groups of main and satellite explosive charges are formed of charges which are adjacent to each other. The detonation of main and satellite explosive charges in groups, rather than detonation of all of the main explosive charges and all of the satellite explosive charges simultaneously, is preferred to limit seismic shock of the detonation. In addition, the charges are detonated in groups for explosively expanding unfragmented formation for forming a reasonably uniform fragmented permeable mass of formation particles having a reasonably uniform void fraction therein.

Figure 6:
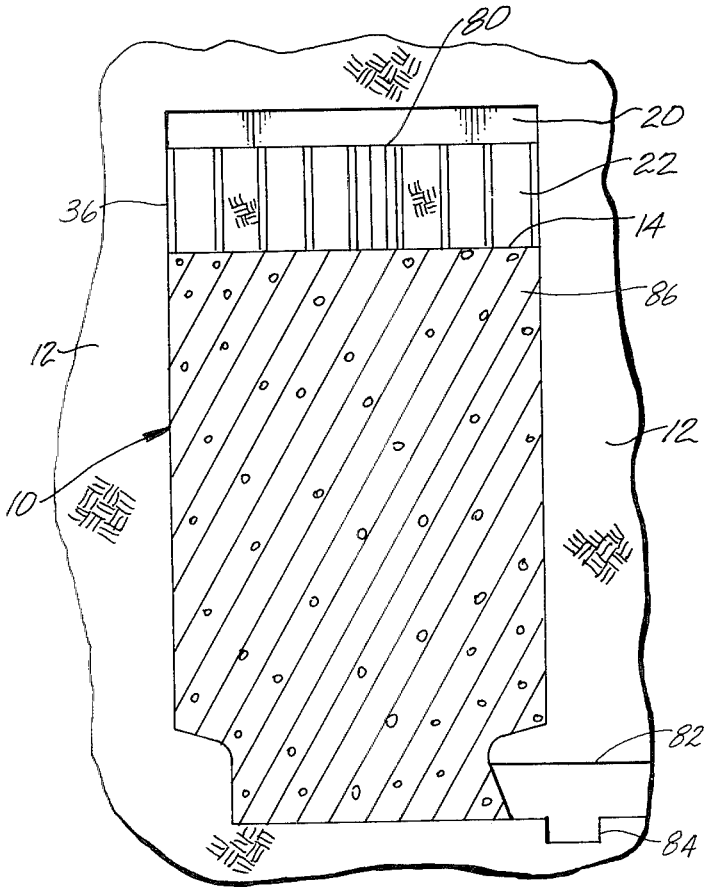
FIG. 6 is a fragmentary, semi-schematic vertical cross-sectional view of a completed in situ oil shale retort formed according to principles of this invention.

After having formed a fragmented permeable mass of oil shale particles in an in situ oil shale retort 10 as illustrated in FIG. 6, the final preparation steps for producing liquid and gaseous products from the retort are carried out. These steps include drilling of at least one gas feed inlet passage 80 downwardly from the base of operation 20 to the top boundary 14 of unfragmented formation so that oxygen-supplying gas can be introduced into the fragmented mass during the retorting operations.

Alternatively, at least a portion of the blastholes 36 through the sill pillar 22 can be used for introduction of the oxygen-supplying gas. Alternatively, the upper boundary of the retort can be adjacent the rectangular limited void 24 and the sill pillar 22 also explosively expanded. In such an embodiment, a retort inlet mixture is introduced from an overlying or laterally adjacent drift. A substantially horizontal product withdrawal drift 82 extends away from the lower portion of the fragmented mass at the lower production level. The product withdrawal drift 82 is used for removal of liquid and gaseous products of retorting.

During retorting operations, a combustion zone is established in the fragmented permeable mass of formation particles 86 and the combustion zone is advanced downwardly through such fragmented mass by introduction of oxygen-supplying gas into the retort. Combustion gas produced in the combustion zone passes through the fragmented mass to establish a retorting zone on the advancing side of the combustion zone wherein kerogen in the oil shale is retorted to produce liquid and gaseous products of retorting. The liquid products and an off gas containing gaseous products passes to the bottom of the fragmented mass and are withdrawn from product withdrawal drift. A pump (not shown) is used to withdraw liquid products from a sump 84 to above ground. Off gas is withdrawn by a blower (not shown) and passed to above ground.

The above description of a method for recovering oil shale from a subterranean formation containing oil shale including the description of preparing the zones of unfragmented formation for explosive expansion is for illustrative purposes. Because of variations which will be apparent to those skilled in the art, the present invention is not intended to be limited to the particular embodiments described above. The scope of the invention is defined in the following claims.

What is claimed is:

1. A method for forming an in situ oil shale retort in a retort site within a subterranean formation containing oil shale, such an in situ oil shale retort containing a fragmented permeable mass of formation particles containing oil shale comprising the steps of:

excavating formation to form at least one void in the subterranean formation leaving zones of unfragmented formation above and below such a void, such a zone of unfragmented formation having a substantially horizontal free face adjoining the void;

forming substantially vertical blastholes in at least one of such zones of unfragmented formation for forming at least one array of spaced apart blastholes;

placing explosive into such blastholes for forming a substantially horizontal array of main explosive charges and at least one substantially horizontal array of satellite explosive charges, wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating explosive in the blastholes in a single round of explosions for explosively expanding at least one of the zones of unfragmented formation toward such a void to form a fragmented permeable mass of formation particles containing oil shale in the in situ oil shale retort.

2. The method according to claim 1 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

3. The method according to claim 1 comprising forming the array of main explosive charges and the array of satellite explosive charges by:

placing a first explosive charge into each blasthole for forming the substantially horizontal array of main explosive charges; and placing a second explosive charge into at least a portion of such blastholes for forming the array of satellite explosive charges.

4. The method according to claim 3 comprising detonating such a main explosive charge and satellite explosive charge located in the same blasthole substantially simultaneously.

5. The method according to claim 3 wherein the first explosive charge has a first energy per unit volume of explosive charge and the second explosive charge has a second energy per unit volume of explosive charge, such second energy per unit volume being less than the first energy per unit volume.

6. The method according to claim 1 wherein the blastholes are formed in a substantially rectangular array wherein the length of a side of each rectangle defined by each four adjacent blastholes is not less than about 75% of the length of another side of such rectangle.

7. The method according to claim 6 wherein the blastholes are formed in a substantially square array.

8. The method according to claim 1 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the substantially horizontal array of main explosive charges; and placing explosive into the second set of blastholes for providing the substantially horizontal array of satellite explosive charges.

9. The method according to claim 8 comprising forming each satellite explosive charge having an actual depth of burial less than the actual depth of burial of each main explosive charge by forming each satellite explosive charge having a longer charge length than each main explosive charge.

10. The method according to claim 8 comprising forming each satellite explosive charge having an actual depth of burial less than the actual depth of burial of each main explosive charge by forming such first set of blastholes longer than such second set of blastholes.

11. The method according to claim 1 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming the array of main explosive charges; and placing explosive in each blasthole of the second substantially rectangular array for forming such an array of satellite charges.

12. The method according to claim 11 wherein the length of a side of each rectangle defined by each four adjacent blastholes of the first array is not less than about 75% of the length of another side of such rectangle.

13. The method according to claim 1 comprising providing at least one group of main explosive charges and at least one group of satellite explosive charges wherein a first group of main explosive charges is detonated substantially simultaneously with a first group of satellite explosive charges.

14. The method according to claim 1 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

15. A method according to claim 1 wherein the ratio of actual depth of burial to spacing distance of the satellite explosive charges is less than the ratio of actual depth of burial to spacing distance of the main explosive charges.

16. A method for explosively expanding formation toward a limited void in a subterranean formation which comprises the steps of:

excavating formation to form at least one limited void in the subterranean formation leaving zones of unfragmented formation adjacent such a void, such a zone of unfragmented formation having a free face adjoining the void;

forming blastholes in at least one of such zones of unfragmented formation for forming an array of spaced apart blastholes;

placing explosive into such blastholes for forming an array of main explosive charges and an array of satellite explosive charges, wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating explosive in the blastholes in a single round of explosions for explosively expanding at least one of the zones of unfragmented formation toward such a void to form a fragmented permeable mass of formation particles in the subterranean formation.

17. The method according to claim 16 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

18. The method according to claim 16 comprising forming the array of main explosive charges and the array of satellite explosive charges by:

placing a first explosive charge into each blasthole for forming the array of main explosive charges; and placing a second explosive charge into at least a portion of such blastholes for forming such an array of satellite explosive charges.

19. The method according to claim 17 comprising detonating such a main explosive charge and satellite explosive charge located in the same blasthole substantially simultaneously.

20. The method according to claim 16 wherein the first explosive charge has a first energy per unit volume of explosive charge and the second explosive charge has a second energy per unit volume of explosive charge, such second energy per unit volume being less than the first energy per unit volume.

21. The method according to claim 16 wherein the blastholes are formed in a substantially rectangular array wherein the length of a side of each rectangle defined by each four adjacent blastholes is not less than about 75% of the length of another side of such rectangle.

22. The method according to claim 21 wherein the blastholes are formed in a substantially square array.

23. The method according to claim 21 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the array of main explosive charges; and placing explosive into the second set of blastholes for providing such an array of satellite explosive charges.

24. The method according to claim 23 comprising forming each satellite explosive charge having an actual depth of burial less than the actual depth of burial of each main explosive charge by forming each satellite explosive charge having a longer charge length than each main explosive charge.

25. The method according to claim 23 comprising forming each satellite explosive charge having an actual depth of burial less than the actual depth of burial of each main explosive charge by forming such first set of blastholes longer than such second set of blastholes.

26. The method according to claim 16 comprising:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming such an array of main explosive charges; and placing explosive in each blasthole of the second substantially rectangular array for forming such an array of satellite explosive charges.

27. The method according to claim 26 wherein the length of a side of each rectangle defined by each four adjacent blastholes of the first array is not less than about 75% of the length of another side of such rectangle.

28. The method according to claim 16 comprising providing at least one group of main explosive charges and at least one group of satellite explosive charges wherein a first group of main explosive charges is detonated substantially simultaneously with a first group of satellite explosive charges.

29. The method according to claim 16 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

30. A method according to claim 16 wherein the ratio of actual depth of burial to spacing distance of the satellite explosive charges is less than the ratio of actual depth of burial to spacing distance of the main explosive charges.

31. A method for forming an in situ oil shale retort in a retort site within a subterranean formation containing oil shale, such an in situ oil shale retort containing a fragmented permeable mass of formation particles containing oil shale comprising the steps of:

excavating formation to form at least one limited void in the subterranean formation leaving zones of unfragmented formation above and below such a void, such a zone of unfragmented formation having a substantially horizontal free face adjoining the void;

forming a substantially horizontal array of main explosive charges and at least one substantially horizontal array of satellite explosive charges in the formation wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating the explosive charges in a single round of explosions for explosively expanding at least one of the zones of unfragmented formation toward such a void to form a fragmented permeable mass of formation particles containing oil shale in an in situ oil shale retort.

32. The method according to claim 31 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

33. The method according to claim 32 comprising forming each satellite explosive charge having an actual depth of burial less than the actual depth of burial of each main explosive charge by forming each satellite explosive charge having a longer charge length than each main explosive charge.

34. A method according to claim 31 wherein the ratio of actual depth of burial to spacing distance of the satellite explosive charges is less than the ratio of actual depth of burial to spacing distance of the main explosive charges.

35. A method according to claim 31 comprising detonating at least a portion of such satellite explosive charges substantially simultaneously with detonation of at least a portion of such main explosive charges.

36. A method of recovering shale oil from an in situ oil shale retort within a subterranean formation containing oil shale, such an in situ oil shale retort containing a fragmented permeable mass of formation particles containing oil shale comprising the steps of:

excavating formation to form at least one limited void in the subterranean formation leaving zones of unfragmented formation above and below such a void, such a zone of unfragmented formation having a substantially horizontal free face adjoining the void;

forming substantially vertical blastholes in at least one of such zones of unfragmented formation for forming at least one array of spaced apart blastholes;

placing explosive into such blastholes for forming a substantially horizontal array of main explosive charges and at least one substantially horizontal array of satellite explosive charges, wherein each satellite charge has a scaled point charge depth of burial substantially equal to the scaled point charge depth of burial of each of the main explosive charges, and the actual depth of burial of each of the satellite explosive charges is less than the actual depth of burial of each of the main explosive charges;

detonating explosive in the blastholes in a single round of explosions for explosively expanding at least one of such zones of unfragmented formation toward such a void to form a fragmented permeable mass of formation particles containing oil shale in an in situ oil shale retort; and introducing an oxygen-supplying gas into such an oil shale retort for establishing a retorting zone in the fragmented permeable mass wherein oil shale is retorted to produce gaseous and liquid products, and for advancing the retorting zone through the fragmented permeable mass, and withdrawing gaseous and liquid products from the retort.

37. The method according to claim 36 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

38. The method according to claim 36 comprising forming the array of main explosive charges and the array of satellite explosive charges by:

placing a first explosive charge in each blasthole for forming the substantially horizontal array of main explosive charges; and placing a second explosive charge in a plurality of such blastholes for forming the array of satellite explosive charges.

39. The method according to claim 38 comprising detonating such a main explosive charge and satellite explosive charge located in the same blasthole substantially simultaneously.

40. The method according to claim 38 wherein the first explosive charge has a first energy per unit volume of explosive charge and the second explosive charge has a second energy per unit volume of explosive charge, such second energy per unit volume being less than the first energy per unit volume.

41. The method according to claim 33 wherein the blastholes are formed in a substantially rectangular array wherein the length of a side of each rectangle defined by each four adjacent blastholes is no less than about 75% of the length of another side of such rectangle.

42. The method according to claim 31 wherein the blastholes are formed in a substantially square array.

43. The method according to claim 31 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the substantially horizontal array of main explosive charges; and placing explosive into the second set of blastholes for providing the substantially horizontal array of satellite explosive charges.

44. The method according to claim 43 comprising forming each satellite explosive charge having an actual depth of burial less than the actual depth of burial of each main explosive charge by forming each satellite explosive charge having a longer charge length than each main explosive charge.

45. The method according to claim 36 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive into each blasthole of the first substantially rectangular array for forming such an array of main explosive charges; and placing explosive into each blasthole of the second substantially rectangular array for forming such an array of satellite charges.

46. The method according to claim 45 wherein the length of a side of each rectangle defined by each four adjacent blastholes of the first array is not less than about 75% of the length of another side of such rectangle.

47. The method according to claim 45 comprising providing at least one group of main explosive charges and at least one group of satellite explosive charges wherein a first group of main explosive charges is detonated substantially simultaneously with a first group of satellite explosive charges.

48. The method according to claim 36 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

49. A method according to claim 36 wherein the ratio of actual depth of burial to spacing distance of the satellite explosive charges is less than the ratio of actual depth of burial to spacing distance of the main explosive charges.

50. A method for forming an in situ oil shale retort in a retort site within a subterranean formation containing oil shale, such as in situ oil shale retort containing a fragmented permeable mass of formation particles containing oil shale comprising the steps of:

forming at least one void in the subterranean formation leaving zones of unfragmented formation above and below such a void, such a zone of unfragmented formation having a substantially horizontal free face adjoining the void;

forming a plurality of substantially vertical blastholes in at least one of such zones of unfragmented formation for forming at least one array of spaced apart blastholes;

placing explosive into such blastholes for forming an array of main explosive charges and at least one array of satellite explosive charges, wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating the explosive charges in the blastholes, in a single round of explosions, for explosively expanding at least one of the zones of unfragmented formation toward such a void for forming a fragmented permeable mass of formation particles containing oil shale in the in situ oil shale retort.

51. The method according to claim 50 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

52. The method according to claim 50 comprising forming the array of main explosive charges and the array of satellite explosive charges by:

placing a first explosive charge into each blasthole for forming the array of main explosive charges; and placing a second explosive charge into at least a portion of such blastholes for forming the array of satellite explosive charges.

53. The method according to claim 52 comprising detonating such a main explosive charge and satellite explosive charge located in the same blasthole substantially simultaneously.

54. The method according to claim 50 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the array of main explosive charges; and placing explosive into the second set of blastholes for providing the array of satellite explosive charges.

55. The method according to claim 54 comprising forming each satellite explosive charge having an actual depth of burial less than the actual depth of burial of each main explosive charge by forming each satellite explosive charge having a longer charge length than each main explosive charge.

56. The method according to claim 54 comprising forming each satellite explosive charge having an actual depth of burial less than the actual depth of burial of each main explosive charge by forming such first set of blastholes longer than such second set of blastholes.

57. The method according to claim 50 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming the array of main explosive charges; and placing explosive in each blasthole of the second substantially rectangular array for forming such an array of satellite charges.

58. The method according to claim 50 comprising providing at least one group of main explosive charges and at least one group of satellite explosive charges wherein a first group of main explosive charges is detonated substantially simultaneously with a first group of satellite explosive charges.

59. The method according to claim 50 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

60. A method according to claim 50 wherein the ratio of actual depth of burial to spacing distance of the satellite explosive charges is less than the ratio of actual depth of burial to spacing distance of the main explosive charges.

61. A method for explosively expanding formation toward a limited void in a subterranean formation which comprises the steps of:

forming at least one limited void in the subterranean formation leaving a zone of unfragmented formation adjacent such a void, the zone of unfragmented formation having a free face adjoining the void;

forming blastholes in the zone of unfragmented formation for forming an array of spaced apart blastholes;

placing explosive into such blastholes for forming an array of main explosive charges and an array of satellite explosive charges, wherein the actual depth of burial of each of the satellite explosive charges is less than the actual depth of burial of each of the main explosive charges and the ratio of actual depth of burial to spacing distance of the satellite explosive charges is less than the ratio of actual depth of burial to spacing distance of the main explosive charges; and detonating such main explosive charges and satellite explosive charges in a single round of explosions for explosively expanding at least one of the zones of unfragmented formation toward such a void for forming a fragmented permeable mass of formation particles in the subterranean formation.

62. The method according to claim 61 comprising providing at least one group of main explosive charges and at least one group of satellite explosive charges wherein a first group of main explosive charges is detonated substantially simultaneously with a first group of satellite explosive charges.

63. The method according to claim 61 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

64. The method according to claim 61 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

65. The method according to claim 61 comprising forming the array of main explosive charges and the array of satellite explosive charges by:

placing a first explosive charge into each blasthole for forming the array of main explosive charges; and placing a second explosive charge into at least a portion of such blastholes for forming such an array of satellite explosive charges.

66. The method according to claim 61 wherein such a main explosive charge and such a satellite explosive charge are located in the same blasthole and comprising detonating such main explosive charge and satellite explosive charge substantially simultaneously.

67. A method according to claim 61 wherein the ratio of actual depth of burial to spacing distance of the satellite explosive charges is less than the ratio of actual depth of burial to spacing distance of the main explosive charges.

68. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation, leaving a zone of unfragmented formation above such a void having a substantially horizontal free face adjoining the void;

forming at least one array of spaced apart substantially vertical blastholes in the zone of unfragmented formation above the void;

placing explosive in such blastholes for forming an array of main explosive charges in the zone of unfragmented formation and at least one array of satellite explosive charges in the zone of unfragmented formation between the array of main explosive charges and the free face wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating the explosive charges in a single round of explosions for explosively expanding the zone of unfragmented formation toward the void for forming a fragmented permeable mass of formation particles containing oil shale in an in situ oil shale retort.

69. The method according to claim 68 wherein the length of each of the main explosive charges is about one-half the thickness of the zone of unfragmented formation and wherein such a main explosive charge is located in the portion of the zone of unfragmented formation most remote from the free face.

70. The method according to claim 68 comprising forming the array of main explosive charges and the array of satellite explosive charges by:

placing a first explosive charge into each blasthole for forming the substantially horizontal array of main explosive charges; and placing a second explosive charge into at least a portion of such blastholes for forming the array of satellite explosive charges.

71. The method according to claim 68 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming the array of main explosive charges; and placing explosive in each blasthole of the second substantially rectangular array for forming such an array of satellite charges.

72. The method according to claim 68 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

73. A method according to claim 68 comprising detonating at least a portion of such satellite explosive charges substantially simultaneously with detonation of at least a portion of such main explosive charges.

74. A method according to claim 68 wherein the ratio of actual depth of burial to spacing distance of the satellite explosive charges is less than the ratio of actual depth of burial to spacing distance of the main explosive charges.

75. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation, leaving a zone of unfragmented formation above such a void having a substantially horizontal free face adjoining the void;

forming at least one array of spaced apart substantially vertical blastholes in the zone of unfragmented formation above the void by:

forming a first set of blastholes, each of such first blastholes having a substantially equal hole diameter; and forming a second set of blastholes, each of such second blastholes having a substantially equal hole diameter, the hole diameter of each of the second blastholes being less than the hole diameter of each of the first blastholes;

placing explosive into the first set of blastholes for providing a substantially horizontal array of main explosive charges in the zone of unfragmented formation;

placing explosive into the second set of blastholes for providing a substantially horizontal array of satellite explosive charges in the zone of unfragmented formation, wherein each of the satellite explosive charges has a scaled point charge depth of burial substantially equal to the scaled point charge depth of burial of each of the main explosive charges and the actual depth of burial of each of the satellite explosive charges is less than the actual depth of burial of each of the main explosive charges; and detonating the explosive charges in a single round of explosions for explosively expanding the zone of unfragmented formation toward the void for forming a fragmented permeable mass of formation particles containing oil shale in an in situ oil shale retort.

76. A method of recovering shale oil from an in situ oil shale retort within a subterranean formation containing oil shale, such an in situ oil shale retort containing a fragmented permeable mass of formation particles containing oil shale comprising the steps of:

forming at least one void in the subterranean formation leaving a zone of unfragmented formation above such a void having a substantially horizontal free face adjoining the void;

forming a plurality of spaced apart substantially vertical blastholes in an array extending across the zone of unfragmented formation;

placing explosive into such blastholes for forming an array of main explosive charges and at least one array of satellite explosive charges, wherein each satellite charge has a scaled point charge depth of burial substantially equal to the scaled point charge depth of burial of each of the main explosive charges and the actual depth of burial of each of the satellite explosive charges is less than the actual depth of burial of each of the main explosive charges;

detonating the explosive charges in the blastholes in a single round of explosions for explosively expanding the zone of unfragmented formation toward the void for forming a fragmented permeable mass of formation particles containing oil shale in an in situ oil shale retort; and introducing an oxygen-supplying gas into the oil shale retort for establishing a retorting zone in the fragmented permeable mass wherein oil shale is retorted to produce gaseous and liquid products and for advancing the retorting zone through the fragmented permeable mass; and withdrawing gaseous and liquid products including shale oil from the retort.

77. The method according to claim 76 wherein the length of each of the main explosive charges is about one-half the thickness of the zone of unfragmented formation and wherein such a main explosive charge is located in the portion of the zone of unfragmented formation most remote from the free face.

78. The method according to claim 76 comprising forming the array of main explosive charges and the array of satellite explosive charges by:

placing a first explosive charge in each blasthole for forming the array of main explosive charges; and placing a second explosive charge in a plurality of such blastholes for forming the array of satellite explosive charges.

79. The method according to claim 78 comprising detonating such a main explosive charge and satellite explosive charge located in the same blasthole substantially simultaneously.

80. The method according to claim 78 wherein the first explosive charge has a first energy per unit volume of explosive charge and the second explosive charge has a second energy per unit volume of explosive charge, such second energy per unit volume being less than the first energy per unit volume.

81. The method according to claim 76 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the array of main explosive charges; and placing explosive into the second set of blastholes for providing the array of satellite explosive charges.

82. The method according to claim 81 comprising forming each satellite explosive charge having an actual depth of burial less than the actual depth of burial of each main explosive charge by forming each satellite explosive charge having a longer charge length than each main explosive charge.

83. The method according to claim 76 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive into each blasthole of the first substantially rectangular array for forming such an array of main explosive charges; and placing explosive into each blasthole of the second substantially rectangular array for forming such an array of satellite charges.

84. The method according to claim 76 comprising providing at least one group of main explosive charges and at least one group of satellite explosive charges wherein a first group of main explosive charges is detonated substantially simultaneously with a first group of satellite explosive charges.

85. The method according to claim 76 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

86. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation leaving zones of unfragmented formation above and below such a void, such a zone of unfragmented formation having a substantially horizontal free face adjoining the void;

forming substantially vertical blastholes in at least one of such zones of unfragmented formation for forming at least one array of spaced apart blastholes;

placing explosive into such blastholes for forming an array of main explosive charges and at least one array of satellite explosive charges, wherein the actual depth of burial of each of the satellite explosive charges is less than the actual depth of burial of each of the main explosive charges; and detonating such explosive charges in a single round of explosions for explosively expanding at least one of the zones of unfragmented formation toward such a void for forming a fragmented permeable mass of formation particles containing oil shale in the in situ oil shale retort wherein at least a portion of such satellite charges are detonated substantially simultaneously with detonation of at least a portion of such main explosive charges.

87. The method according to claim 86 comprising forming the array of main explosive charges and the array of satellite explosive charges by:

placing a first explosive charge into each blasthole for forming the array of main explosive charges; and placing a second explosive charge into at least a portion of such blastholes for forming the array of satellite explosive charges.

88. The method according to claim 87 comprising detonating such a main explosive charge and satellite explosive charge located in the same blasthole substantially simultaneously.

89. The method according to claim 86 wherein the steps of forming blastholes and placing explosive comprise:

forming a first set of blastholes, each of such first blastholes having a substantially equal hole diameter;

forming a second set of blastholes, each of such second blastholes having a substantially equal hole diameter, the hole diameter of each of the second blastholes being less than the hole diameter of each of the first blastholes;

placing explosive into the first set of blastholes for providing the array of main explosive charges; and placing explosive into the second set of blastholes for providing the array of satellite explosive charges.

90. The method according to claim 86 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming the array of main explosive charges; and placing explosive in each blasthole of the second substantially rectangular array for forming such an array of satellite charges.

91. The method according to claim 86 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

92. A method for explosively expanding formation toward a limited void in a subterranean formation which comprises the steps of:

forming at least one limited void in the subterranean formation leaving zones of unfragmented formation adjacent such a void, such a zone of unfragmented formation having a free face adjoining the void;

forming blastholes in at least one of such zones of unfragmented formation for forming an array of spaced apart blastholes extending across such zone;

placing explosive into such blastholes for forming an array of main explosive charges and an array of satellite explosive charges, wherein the actual depth of burial of each of the satellite explosive charges is less than the actual depth of burial of each of the main explosive charges; and detonating such explosive charges in a single round of explosions for explosively expanding at least one of the zones of unfragmented formation toward such a void for forming a fragmented permeable mass of formation particles in the subterranean formation wherein at least a portion of such satellite explosive charges are detonated substantially simultaneously with detonation of at least a portion of such main explosive charges.

93. The method according to claim 92 comprising forming the array of main explosive charges and the array of satellite explosive charges by:

placing a first explosive charge into each blasthole for forming the array of main explosive charges; and placing a second explosive charge into at least a portion of such blastholes for forming such an array of satellite explosive charges.

94. The method according to claim 92 comprising detonating such a main explosive charge and satellite explosive charge located in the same blasthole substantially simultaneously.

95. The method according to claim 92 comprising:

forming a first substantially rectangular array of spaced apart blastholes;

forming a second substantially rectangular array of spaced apart blastholes, the second array having substantially the same spacing distance as the first array and the second array being diagonally offset from the first array by less than about the spacing distance;

placing explosive in each blasthole of the first substantially rectangular array for forming the array of main explosive charges; and placing explosive in each blasthole of the second substantially rectangular array for forming the array of satellite explosive charges.

96. The method according to claim 92 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

97. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation, leaving a zone of unfragmented formation above such a void having a substantially horizontal free face adjoining the void;

forming at least one array of spaced apart substantially vertical blastholes in the zone of unfragmented formation above the void;

placing explosive in such blastholes for forming an array of main explosive charges in the zone of unfragmented formation and at least one array of satellite explosive charges in the zone of unfragmented formation between the array of main explosive charges and the free face wherein the actual depth of burial of each of the satellite explosive charges is less than the actual depth of burial of each of the main explosive charges; and detonating the explosive charges in a single round of explosions for explosively expanding the zone of unfragmented formation toward the void for forming a fragmented permeable mass of formation particles containing oil shale in an in situ oil shale retort, wherein at least a portion of the satellite explosive charges are detonated substantially simultaneously with at least a portion of the main explosive charges.

98. The method according to claim 97 wherein the length of each of the main explosive charges is about one-half the thickness of the zone of unfragmented formation and wherein such a main explosive charge is located in the portion of the zone of unfragmented formation most remote from the free face.

99. A method for forming an in situ oil shale retort within a subterranean formation containing oil shale, such an in situ oil shale retort containing a fragmented permeable mass of formation particles containing oil shale comprising the steps of:

forming at least one void in the subterranean formation leaving a zone of unfragmented formation above such a void having a substantially horizontal free face adjoining the void;

forming a plurality of spaced apart substantially vertical blastholes in an array extending across the zone of unfragmented formation;

placing explosive into such blastholes for forming a substantially horizontal array of main explosive charges and at least one array of satellite explosive charges, wherein the actual depth of burial of each of the satellite explosive charges is less than the actual depth of burial of each of the main explosive charges; and detonating the explosive charges in a single round of explosions for explosively expanding the zone of unfragmented formation toward the void for forming a fragmented permeable mass of formation particles containing oil shale in an in situ oil shale retort, wherein at least a portion of the satellite explosive charges are detonated substantially simultaneously with detonation of at least a portion of the main explosive charges.

100. The method according to claim 99 comprising forming the array of main explosive charges and the array of satellite explosive charges by:

placing a first explosive charge in each blasthole for forming the substantially horizontal array of main explosive charges; and placing a second explosive charge in a plurality of such blastholes for forming the array of satellite explosive charges.

101. The method according to claim 100 comprising detonating such a main explosive charge and satellite explosive charge located in the same blasthole substantially simultaneously.

102. The method according to claim 99 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive into each blasthole of the first substantially rectangular array for forming such an array of main explosive charges; and placing explosive into each blasthole of the second substantially rectangular array for forming such an array of satellite charges.

103. The method according to claim 99 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

104. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation leaving zones of unfragmented formation above and below such a void, such a zone of unfragmented formation having a substantially horizontal free face adjoining the void;

forming substantially vertical blastholes in at least one of such zones of unfragmented formation for forming at least one array of spaced apart blastholes;

placing explosive into such blastholes for forming an array of main explosive charges and at least one array of satellite explosive charges, wherein the actual depth of burial of each of the satellite explosive charges is less than the actual depth of burial of each of the main explosive charges and the ratio of actual depth of burial to spacing distance of the satellite charges is less than the ratio of actual depth of burial to spacing distance of the main explosive charges; and detonating such explosive charges in a single round of explosions for explosively expanding at least one of the zones of unfragmented formation toward such a void for forming a fragmented permeable mass of formation particles containing oil shale in the in situ oil shale retort.

105. The method according to claim 104 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

106. The method according to claim 104 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming the array of main explosive charges; and placing explosive in each blasthole of the second substantially rectangular array for forming such an array of satellite charges.

107. The method according to claim 104 comprising providing at least one group of main explosive charges and at least one group of satellite explosive charges wherein a first group of main explosive charges is detonated substantially simultaneously with a first group of satellite explosive charges.

108. The method according to claim 104 wherein the steps of forming blastholes and placing explosive comprises:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

109. A method for explosively expanding formation toward a limited void in a subterranean formation which comprises the steps of:

excavating formation to form at least one limited void in the subterranean formation leaving zones of unfragmented formation adjacent such a void, such a zone of unfragmented formation having a free face adjoining the void;

forming blastholes in at least one of such zones of unfragmented formation for forming an array of spaced apart blastholes;

placing explosive into such blastholes for forming an array of main explosive charges and an array of satellite explosive charges, wherein the actual depth of burial of each of the satellite explosive charges is less than the actual depth of burial of each of the main explosive charges and the ratio of actual depth of burial to spacing distance of the satellite charges is less than the ratio of actual depth of burial to spacing distance of the main explosive charges; and detonating the explosive charges in a single round of explosions for explosively expanding at least one of the zones of unfragmented formation toward such a void for forming a fragmented permeable mass of formation particles in the subterranean formation.

110. The method according to claim 109 wherein the length of each of the main explosive charges is about one-half the thickness of such a zone of unfragmented formation which is to be expanded towards such a free face and wherein such a main explosive charge is located in the portion of the unfragmented formation most remote from the free face toward which such unfragmented formation is to be explosively expanded.

111. A method according to claim 109 comprising detonating at least a portion of such satellite explosive charges substantially simultaneously with detonation of at least a portion of such main explosive charges.

112. A method for forming an in situ oil shale retort in a retort site within a subterranean formation containing oil shale, such an in situ oil shale retort containing a fragmented permeable mass of formation particles containing oil shale comprising the steps of:

forming at least one void in the subterranean formation, leaving a zone of unfragmented formation above such a void having a substantially horizontal free face adjoining the void;

forming at least one array of spaced apart substantially vertical blastholes in the zone of unfragmented formation above the void;

placing explosive in such blastholes for forming an array of main explosive charges in the zone of unfragmented formation and at least one array of satellite explosive charges in the zone of unfragmented formation between the array of main explosive charges and the free face wherein the actual depth of burial of each of the satellite explosive charges is less than the actual depth of burial of each of the main explosive charges and the ratio of actual depth of burial to spacing distance of the satellite explosive charges is less than the ratio of actual depth of burial to spacing distance of the main explosive charges; and detonating the explosive charges in a single round of explosions for explosively expanding the zone of unfragmented formation toward the void for forming a fragmented permeable mass of formation particles containing oil shale in an in situ oil shale retort.

113. The method according to claim 112 wherein the length of each of the main explosive charges is about one-half the thickness of the zone of unfragmented formation and wherein such a main explosive charge is located in the portion of the zone of unfragmented formation most remote from the free face.

114. The method according to claim 112 comprising forming the array of main explosive charges and the array of satellite explosive charges by:

placing a first explosive charge into each blasthole for forming the array of main explosive charges; and placing a second explosive charge into at least a portion of such blastholes for forming such an array of satellite explosive charges.

115. The method according to claim 112 comprising detonating such a main explosive charge and satellite explosive charge located in the same blasthole substantially simultaneously.

116. The method according to claim 112 comprising:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive in each blasthole of the first substantially rectangular array for forming such an array of main explosive charges; and placing explosive in each blasthole of the second substantially rectangular array for forming such an array of satellite explosive charges.

117. The method according to claim 112 comprising providing at least one group of main explosive charges and at least one group of satellite explosive charges wherein a first group of main explosive charges is detonated substantially simultaneously with a first group of satellite explosive charges.

118. The method according to claim 112 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

119. A method for forming an in situ oil shale retort within a subterranean formation containing oil shale, such an in situ oil shale retort containing a fragmented permeable mass of formation particles containing oil shale comprising the steps of:

forming at least one void in the subterranean formation leaving a zone of unfragmented formation above such a void having a substantially horizontal free face adjoining the void;

forming a plurality of spaced apart substantially vertical blastholes in an array extending across the zone of unfragmented formation;

placing explosive into such blastholes for forming an array of main explosive charges and at least one array of satellite explosive charges, wherein the actual depth of burial of each of the satellite explosive charges is less than the actual depth of burial of each of the main explosive charges and the ratio of actual depth of burial to spacing distance of the satellite explosive charges is less than the ratio of actual depth of burial to spacing distance of the main explosive charges; and detonating the explosive charges in the blastholes in a single round of explosions for explosively expanding the zone of unfragmented formation toward the void for forming a fragmented permeable mass of formation particles containing oil shale in an in situ oil shale retort.

120. The method according to claim 119 wherein the length of each of the main explosive charges is about one-half the thickness of the zone of unfragmented formation and wherein such a main explosive charge is located in the portion of the zone of unfragmented formation most remote from the free face.

121. The method according to claim 119 wherein the steps of forming blastholes and placing explosive comprise:

forming a first substantially rectangular array of spaced apart blastholes;

forming a second substantially rectangular array of spaced apart blastholes, such a second array having substantially the same spacing distance as the first array and such a second array being diagonally offset from such first array by less than about the spacing distance;

placing explosive into each blasthole of the first substantially rectangular array for forming such an array of main explosive charges; and placing explosive into each blasthole of the second substantially rectangular array for forming such an array of satellite charges.

122. The method according to claim 119 comprising providing at least one group of main explosive charges and at least one group of satellite explosive charges wherein a first group of main explosive charges is detonated substantially simultaneously with a first group of satellite explosive charges.

123. The method according to claim 119 wherein the steps of forming blastholes and placing explosive comprise:

forming a first substantially rectangular array of spaced apart blastholes and forming a second substantially rectangular array of spaced apart blastholes;

placing explosive in each blasthole of the first substantially rectangular array for forming the array of main explosive charges; and placing explosive in each blasthole of the first substantially rectangular array and in each blasthole of the second substantially rectangular array for forming such an array of satellite explosive charges.

* * * * *

UNITED STATES PATENT AND TRADEMARK OFFICE

CERTIFICATE OF CORRECTION

PATENT NO. : 4,326,751

DATED : April 27, 1982

INVENTOR(S) : Thomas E. Ricketts

It is certified that error appears in the above-identified patent and that said Letters Patent are hereby corrected as shown below:

Column 15, line 31, "17" should be -- 16 --.
Column 18, line 41, "31" should be -- 41 --.
Column 18, line 43, "31" should be -- 41 --.
Column 19, line 49, "as" should be -- an --.

Signed and Sealed this

Sixth Day of July 1982

[SEAL]

Attest:

GERALD J. MOSSINGHOFF

Attesting Officer

Commissioner of Patents and Trademarks